US007740006B2

(12) United States Patent
Ikeya

(10) Patent No.: US 7,740,006 B2
(45) Date of Patent: Jun. 22, 2010

(54) FUEL-FEEDING DEVICES

(75) Inventor: Masaki Ikeya, Obu (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 71 days.

(21) Appl. No.: 12/328,000

(22) Filed: Dec. 4, 2008

(65) Prior Publication Data

US 2009/0151703 A1 Jun. 18, 2009

(30) Foreign Application Priority Data

Dec. 18, 2007 (JP) ..... 2007-325945

(51) Int. Cl.
*F02M 37/04* (2006.01)
*F02M 37/08* (2006.01)

(52) U.S. Cl. ..... 123/506; 123/457

(58) Field of Classification Search ..... 123/506, 123/457, 459, 465, 447, 514, 468; 138/30, 138/31
See application file for complete search history.

(56) References Cited

U.S. PATENT DOCUMENTS 5,031,596 A * 7/1991 Muraji ..... 123/463
2008/0095642 A1* 4/2008 Schelhas et al. ..... 417/189

FOREIGN PATENT DOCUMENTS

JP 2002235622 8/2002

* cited by examiner

*Primary Examiner*—Mahmoud Gimie
(74) *Attorney, Agent, or Firm*—Dennison, Schultz & MacDonald

(57) ABSTRACT

A fuel-feeding device may preferably include a pressure control valve capable of controlling a pressure of pressurized fuel that includes a housing having an inner cavity, a first movable dividing wall, a second movable dividing wall, a valve unit and a resilient member. The first and second movable dividing walls divide the housing cavity to a pressure controlling chamber, a back pressure chamber, and an open chamber positioned between the pressure controlling chamber and the back pressure chamber. The second movable dividing wall is arranged and constructed to move to a retracted position or an advanced position depending upon whether back pressure fuel is introduced into the back pressure chamber, thereby setting the resilient member to two different set loads.

6 Claims, 5 Drawing Sheets

FUEL-FEEDING DEVICES

This application claims priority to Japanese patent application serial number 2007-325945, the contents of which are incorporated herein by reference.

BACKGROUND OF THE INVENTION

1. Field of the Invention

The present invention relates to a fuel-feeding device and a pressure control valve (a pressure regulator) used in the fuel-feeding device.

2. Description of Related Art

A fuel-feeding device is taught, for example, by Japanese Laid-Open Patent Publication No. 2002-235622. As shown in FIG. 8, this fuel-feeding device includes a fuel pump 1, fuel feeder passages LF1 and LF2, a back pressure generating passage LC having a solenoid valve S, and a pressure control valve 2 (a pressure regulator). The fuel pump 1 is arranged and constructed to feed fuel contained in a fuel tank to a fuel injection valve 3 (a fuel injector) that is capable of injecting the fuel to an engine 4 (an internal-combustion engine). The fuel feeder passage LF1 communicates between the fuel pump 1 and the fuel injection valve 3. The fuel feeder passage LF2 is branched from the fuel feeder passage LF1 so as to communicate with the pressure control valve 2. The back pressure generating passage LC is branched from the fuel feeder passage LF1 so as to communicate with the fuel tank. The pressure control valve 2 is arranged and constructed to control a pressure of the fuel fed to the fuel injection valve 3 (i.e., a pressure of the fuel in the fuel feeder passages LF1 and LF2). This pressure will be referred to as "a fuel pressure."

The pressure control valve 2 includes a back pressure chamber 2*r*, a pressure controlling chamber 2*c*, a diaphragm 2B3 disposed between the chambers 2*r* and 2*c*, and a valve portion 2B attached to the diaphragm 2B3. The back pressure chamber 2*r* communicates with the back pressure generating passage LC, so as to be applied with a (fuel) back pressure P1 intermediate between the fuel pressure and a tank interior pressure when the solenoid valve S is opened. The pressure controlling chamber 2*c* communicates with the fuel feeder passage LF2, so as to be applied with the fuel pressure. Further, the valve portion 2B is capable of controlling a pressure of the fuel in the controlling chamber 2*c* to two control pressures (high and low control pressures) depending on whether the back pressure P1 is applied to the back pressure chamber 2*r*.

When the solenoid valve S is opened, the back pressure chamber 2*r* is applied with the back pressure P1 (a high pressure). As a result, the pressure of the fuel in the pressure controlling chamber 2*c* can be controlled to the high control pressure because of the high pressure within the back pressure chamber 2*r*. Thus, the fuel pressure (the pressure in the fuel feeder passages LF1 and LF2 communicating with the pressure controlling chamber 2*c*) can be controlled to the high control pressure. Conversely, when the solenoid valve S is closed, the back pressure chamber 2*r* is applied with a limited or low pressure because the back pressure chamber 2*r* is not applied with the back pressure P1. As a result, the pressure in the pressure controlling chamber 2*c* can be controlled to the low control pressure because of the low pressure within the back pressure chamber 2*r*. Thus, the fuel pressure can be controlled to the low control pressure.

However, according to the pressure control valve 2, when the back pressure P1 applied to the back pressure chamber 2*r* is changed or fluctuated, the pressure in the pressure controlling chamber 2*c* can be proportionally changed depending on the applied back pressure P1 because the back pressure P1 is directly applied to the diaphragm 2B3. Therefore, if the back pressure P1 applied to the back pressure chamber 2*r* is excessively increased, the pressure in the pressure controlling chamber 2*c* may be excessively increased beyond the high control pressure. This means that the pressure in the pressure controlling chamber 2*c* cannot be accurately controlled to the high control pressure. As a result, the fuel pressure cannot be accurately controlled. This may lead to an inferior controllability of the fuel pressure.

BRIEF SUMMARY OF THE INVENTION

For example, in one embodiment of the present invention, a fuel-feeding device may include a fuel pump capable of feeding fuel contained in a fuel tank to an engine, a pressure control valve capable of controlling a pressure of pressurized fuel pumped from the fuel pump, and a valve device. The pressure control valve includes a housing having an inner cavity, a first movable dividing wall, a second movable dividing wall, a valve unit and a resilient member. The first and second movable dividing walls divide the housing cavity to a pressure controlling chamber having a pressurized fuel inlet port through which the pressurized fuel is introduced into the pressure controlling chamber and an excess fuel relief port through which a portion of the pressurized fuel in the pressure controlling chamber flows out, a back pressure chamber having a back pressure fuel inlet port through which the pressurized fuel is introduced into the back pressure chamber as a back pressure fuel, and an open chamber positioned between the pressure controlling chamber and the back pressure chamber and communicating with exterior of the housing. The valve unit is attached to the first movable dividing wall and capable of closing and opening the excess fuel relief port. The resilient member is disposed between the first and second movable dividing walls so as to normally biasing the valve unit in a valve closing direction. The second movable dividing walls is arranged and constructed to move to a retracted position or an advanced position depending upon whether the back pressure fuel is introduced into the back pressure chamber, thereby setting the resilient member to two different set loads. The valve device is arranged and constructed to controllably introduce the back pressure fuel into the back pressure chamber.

According to the fuel-feeding device thus constructed, the resilient member can be set to the two different set loads (e.g., a low set load and a high set load) depending upon whether the back pressure fuel is introduced into the back pressure chamber. Therefore, the pressure control valve can be reliably set to the two different control pressures (i.e., a low control pressure and a high control pressure) that correspond to the two different set loads of the resilient member. As a result, even if the back pressure applied to the back pressure chamber is changed or fluctuated, a pressure of the pressurized fuel in the pressure controlling chamber can be effectively prevented from being changed or fluctuated in proportion to the change or fluctuation of the back pressure applied to the back pressure chamber. Thus, the pressure of the pressurized fuel in the pressure controlling chamber can be accurately controlled. This means that a pressure of the pressurized fuel fed to the engine can be effectively stabilized.

Other objects, features, and advantages, of the present invention will be readily understood after reading the following detailed description together with the accompanying drawings and the claims.

DETAILED DESCRIPTION OF THE INVENTION

Next, the representative embodiments of the present invention will be described with reference to the drawings.

First Embodiment

A first embodiment of the present invention will be described with reference to FIGS. 1 to 4. This embodiment of the present invention is directed to a fuel-feeding device for use in a vehicle engine (i.e., a fuel-feeding device for feeding fuel to a vehicle engine).

Figure 3:
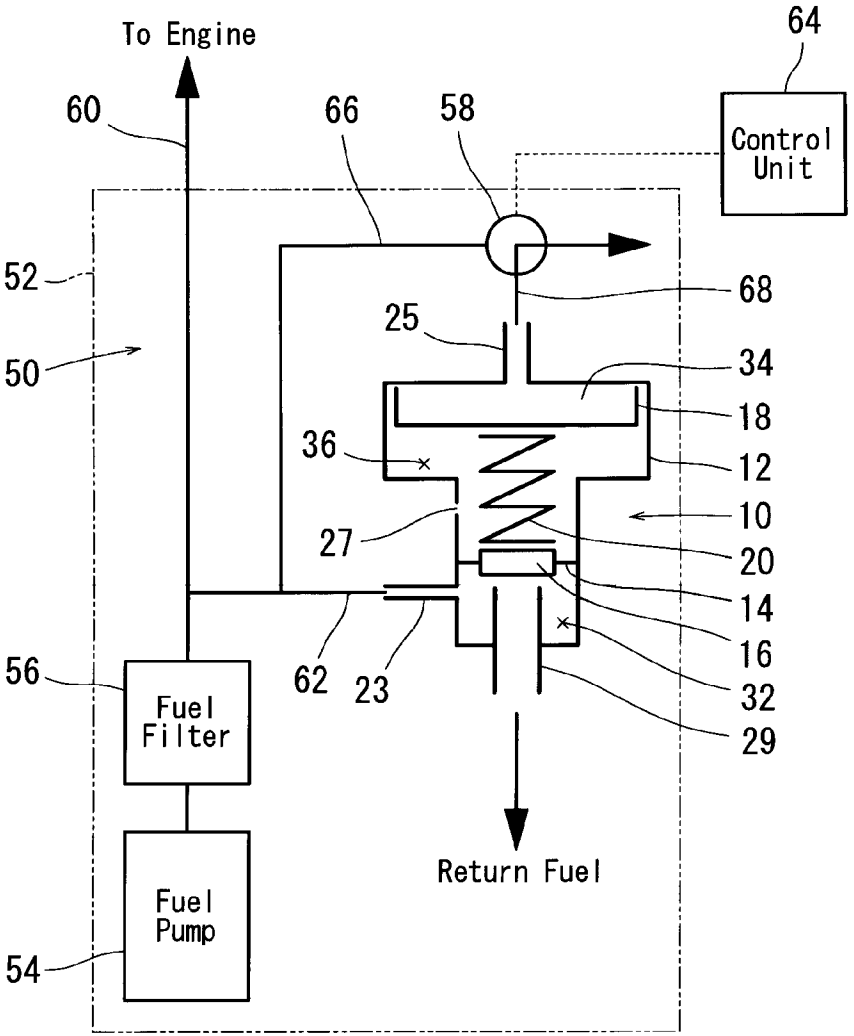
FIG. 3 is a schematic diagram of the fuel-feeding device having the pressure control valve, in which the pressure control valve is controlled such that the fuel can be fed to the engine at the low control pressure.
Figure 4:
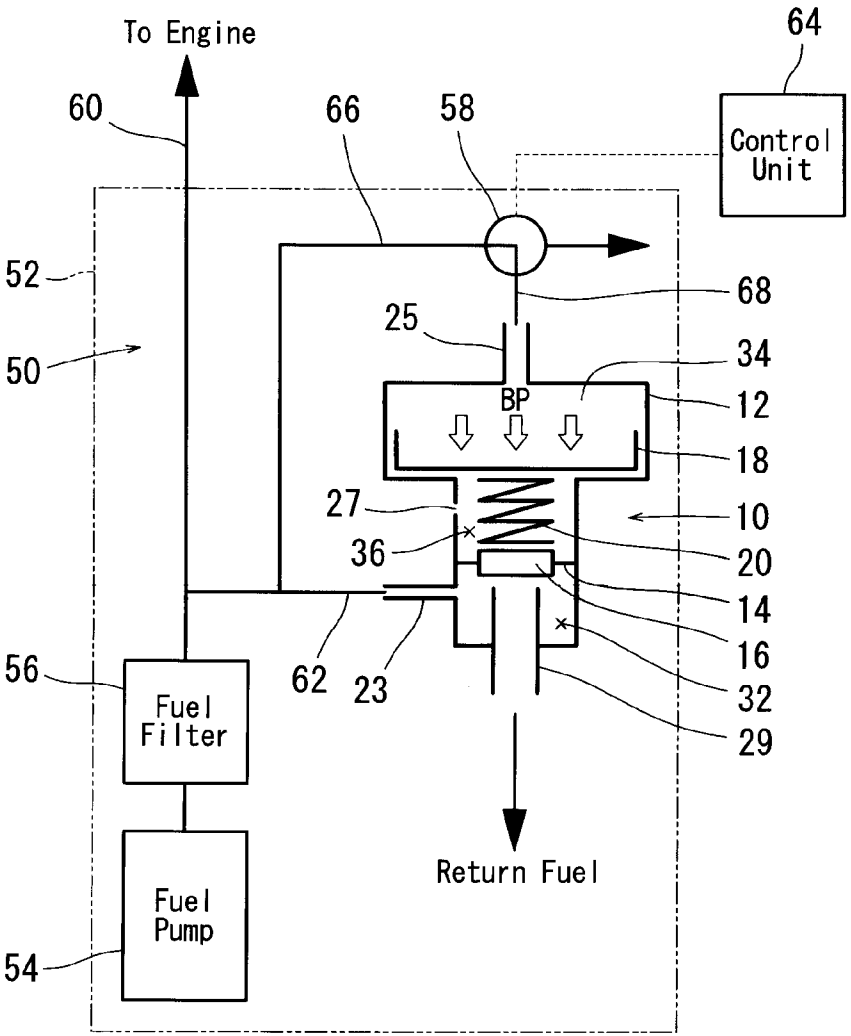
FIG. 4 is a schematic diagram of the fuel-feeding device having the pressure control valve, in which the pressure control valve is controlled such that the fuel can be fed to the engine at the high control pressure.

As shown in FIGS. 3 and 4, the fuel-feeding device 50 may preferably be disposed in a fuel tank 52 of a vehicle (not shown) in which (liquid) fuel is contained. The fuel-feeding device 50 may preferably include a pressure control valve 10 (a pressure regulator), a fuel pump 54, a fuel filter 56 and a valve device 58.

Figure 1:
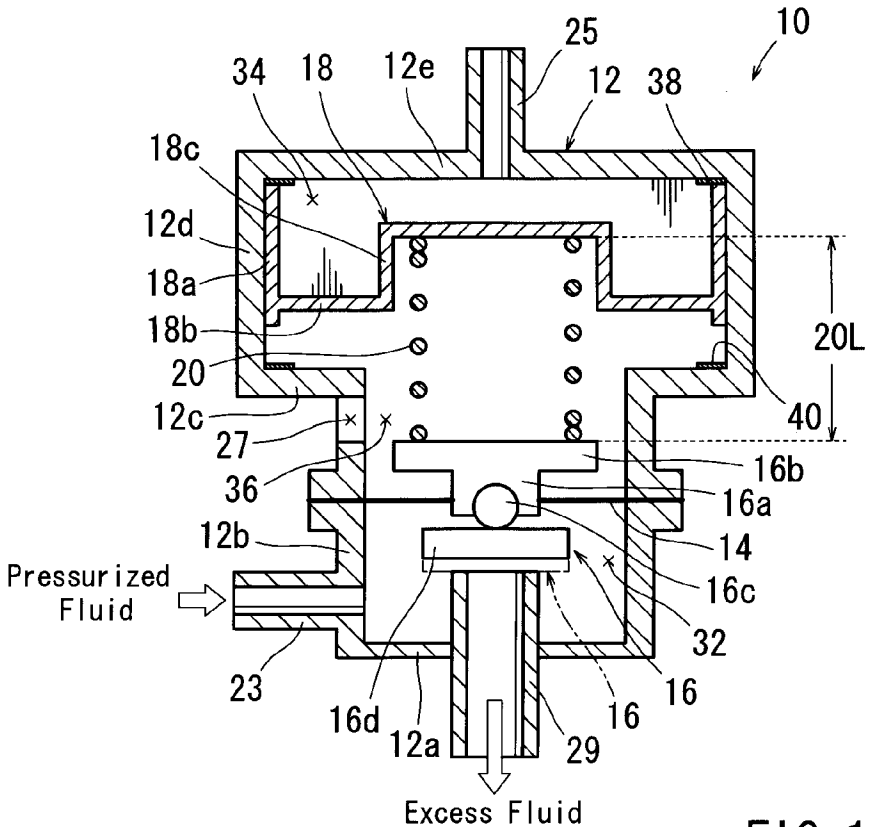
FIG. 1 is a cross-sectional view of a pressure control valve used in a fuel-feeding device according to a first embodiment of the present invention, in which the pressure control valve is controlled such that fuel can be fed to an engine at a low control pressure.
Figure 2:
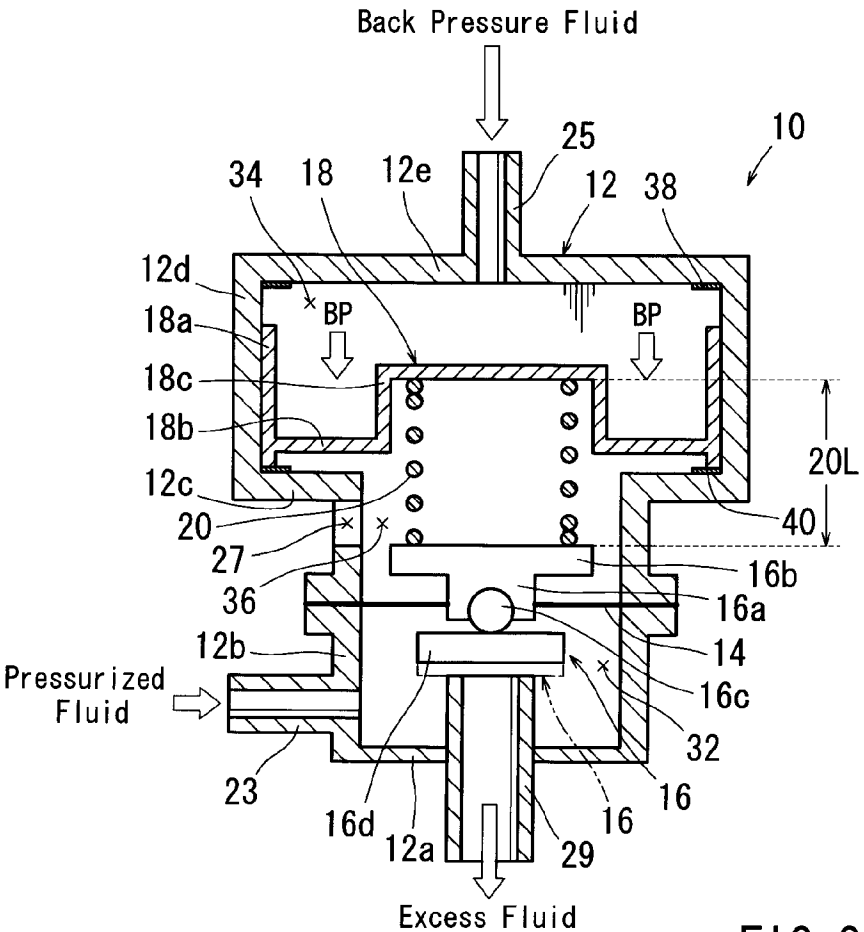
FIG. 2 is a cross-sectional view of the pressure control valve, in which the pressure control valve is controlled such that the fuel can be fed to the engine at a high control pressure.

As shown in FIGS. 1 and 2, the pressure control valve 10 may preferably be composed of a housing 12, a diaphragm 14 (a first movable dividing wall), a valve unit 16, a plunger 18 (a second movable dividing wall) and a valve spring 20 (a resilient member). The housing 12 may preferably include a circular disk-shaped bottom wall portion 12*a*, a cylindrical lower side wall portion 12*b* that can be integrated with the bottom wall portion 12*a*, a transversely extended flanged portion 12*c* that can be integrally formed in an upper periphery of the lower side wall portion 12*b*, a cylindrical upper side wall portion 12*d* that can be integrated with the flanged portion 12*c*, and a circular disk-shaped upper wall portion 12*e* that can be integrated with the upper side wall portion 12*d*. Further, the upper side wall portion 12*d* is coaxially aligned with the lower side wall portion 12*b* and has a diameter greater than a diameter of the lower side wall portion 12*b*. A lower inlet port 23 (a pressurized fuel (fluid) inlet port) is formed in a lower portion of the lower side wall portion 12*b*. An upper inlet port 25 (a back pressure fuel (fluid) inlet port) is formed in the upper wall portion 12*e*, so as to be coaxially aligned with the upper side wall portion 12*d*. Further, an atmosphere communicating hole 27 is formed in an upper portion of the lower side wall portion 12*b*, so as to communicate between interior and exterior of the housing 12 (which will respectively be referred to as "valve interior" and "valve exterior"). A vent port 29 (an excess fuel (fluid) relief port) is formed in the bottom wall portion 12*a*, so as to be coaxially aligned with the lower side wall portion 12*b*.

The diaphragm 14 is disposed in the lower side wall portion 12*b* of the housing 12. The diaphragm 14 may preferably be positioned at a vertically central portion of the lower side wall portion 12*b*, so as to be transversely extended. An outer periphery of the diaphragm 14 thus positioned is connected to an inner circumferential surface of the lower side wall portion 12*b*, so that a cavity of the lower side wall portion 12*b* can be divided to upper and lower cavity portions. The diaphragm 14 may preferably be formed from elastic materials such as rubber, so as to be elastically deformed or flexed vertically (in a thickness direction). Further, in this embodiment, downward deformation and upward deformation of the diaphragm 14 will respectively be referred to as "advancing motion" and "retracting motion" of the diaphragm 14.

The valve unit 16 is arranged and constructed to close and open an upper end of the vent port 29 depending upon the downward and upward deformation of the diaphragm 14. In particular, the valve unit 16 may preferably include a retainer member 16*a*, a spring seat portion 16*b*, a ball 16*c* and a valve plate 16*d* (a valve body). The retainer member 16*a* is positioned at a substantially central portion of the diaphragm 14 and is attached thereto. The spring seat portion 16*b* can be integrally formed in an upper end portion of the retainer member 16*a*. The ball 16*c* is centrally rotatably embedded in the retainer member 16*a* so as to be partly projected downwardly. The valve plate 16*d* is vertically movably positioned between the ball 16*c* and the upper end of the vent port 29.

The plunger 18 may preferably be vertically movably disposed within the upper side wall portion 12*d* of the housing 12. Also, the plunger 18 can be formed in one piece and is arranged and constructed to variably divide a cavity of the upper side wall portion 12*d* to upper and lower cavity portions. In particular, the plunger 18 may preferably be composed of a cylindrical retainer wall portion 18*a* that is closely received in the upper side wall portion 12*d*, and a transversely extended circular disk-shaped portion 18*b* that is connected to a lower end portion of the retainer wall portion 18*a*. Thus, the plunger 18 is capable of sliding along an inner circumferential surface of the upper side wall portion 12*d*. Further, the circular disk-shaped portion 18*b* of the plunger 18 has a recessed portion 18*c* that is upwardly depressed. The recessed portion 18*c* may preferably be formed in a substantially central portion of the circular disk-shaped portion 18*b* so as to be vertically aligned with the spring seat portion 16*b* of the valve unit 16. It should be noted that as best shown in FIGS. 1 and 2, the plunger 18 (the circular disk-shaped portion 18*b* and the cylindrical retainer wall portion 18*a*) may preferably have a diameter greater than the diameter of the diaphragm 14. In other words, the plunger 18 may preferably have an effective pressure receiving area greater than the diaphragm 14. Further, in this embodiment, downward motion and upward motion of the plunger 18 will respectively be referred to as "advancing motion" and "retracting motion" of the plunger 18.

The diaphragm 14 and the plunger 18 may preferably divide an inner cavity of the housing 12 to a lower chamber, an upper chamber and an intermediate chamber. The lower chamber may constitute a pressure controlling chamber 32 that communicates with the lower inlet port 23 and the vent port 29. The upper chamber may constitute a back pressure chamber 34 that communicates with the upper inlet port 25. Further, the intermediate chamber may constitute an open chamber 36 that is positioned between the pressure controlling chamber 32 and the back pressure chamber 34 and communicates with the valve exterior (the exterior of the housing 12) via the atmosphere communicating hole 27.

The valve spring 20 may preferably be formed from a coil spring. The valve spring 20 thus formed is disposed between the spring seat portion 16*b* of the valve unit 16 and the recessed portion 18*c* of the plunger 18. The valve spring 20 thus disposed normally biases the plunger 18 upwardly such that the plunger 18 can normally be moved to and maintained in an uppermost position (i.e., a retracted position). Also, the valve spring 20 normally biases the spring seat portion 16*b* of the valve unit 16 downwardly (i.e., in a valve closing direction).

An annular plate-shaped upper stopper member 38 (a first stopper device) is attached to an inner surface of the upper wall portion 12*e* of the housing 12. As shown in FIG. 1, the upper stopper member 38 is arranged and constructed to contact an upper end surface of the retainer wall portion 18*a* of the plunger 18 when the plunger 18 moves to the uppermost position (the retracted position), thereby stopping the plunger 18 at the uppermost position. In this embodiment, the retainer wall portion 18*a* of the plunger 18 and the upper stopper member 38 may constitute "a first stopper device or a retracting position stopper device."

An annular plate-shaped lower stopper member 40 (a second stopper device) is attached to an inner surface of the flanged portion 12*c* of the housing 12. As shown in FIG. 2, the lower stopper member 40 is arranged and constructed to contact a lower end surface of the retainer wall portion 18*a* of the plunger 18 when the plunger 18 moves to a lowermost position (an advanced position), thereby stopping the plunger 18 at the lowermost position. In this embodiment, the retainer wall portion 18*a* of the plunger 18 and the lower stopper member 40 may constitute "a second stopper device or an advancing position stopper device."

Next, the fuel pump 54 may preferably be constructed as an impeller fuel pump integrated with a motor. As shown in FIGS. 1 and 2, the fuel pump 54 is connected to the engine (not shown) via a fuel feeder passage 60 that is connected to a discharge port (not shown) of the fuel pump 54. The fuel pump 54 is constructed to pump the fuel in the fuel tank 52 toward the engine via the fuel feeder passage 60 upon rotation of an impeller (not shown) of the fuel pump 54.

In particular, the fuel pump 54 is connected to a delivery tube (not shown) having injectors or fuel injection valves (not shown) via the fuel feeder passage 60. Therefore, pressurized fuel (pumped fuel) pumped from the fuel pump 54 can be fed to the delivery tube via the fuel feeder passage 60, and then be injected into combustion chambers (not shown) of the engine via the injectors. Further, the pressurized fuel may also be referred to as "a pressurized fluid."

As shown in FIGS. 3 and 4, the fuel filter 56 is disposed in the fuel feeder passage 60. Therefore, the pressurized fuel pumped from the fuel pump 54 can be filtrated before it is fed to the engine (the injectors).

As shown in FIGS. 3 and 4, a pressurized fuel introduction passage 62 is branched from the fuel feeder passage 60. The pressurized fuel introduction passage 62 is connected to the lower inlet port 23 of the housing 12, so that a portion of the pressurized fuel flowing through the fuel feeder passage 60 can be introduced into the pressure controlling chamber 32 of the housing 12. As a result, a pressure of the pressurized fuel pumped from the fuel pump 54 (i.e., a fuel pressure) can be applied to the pressure controlling chamber 32.

As shown in FIGS. 3 and 4, a control fuel introduction passage 66 (a back pressure fuel introduction passage) is branched from the pressurized fuel introduction passage 62. The control fuel introduction passage 66 is connected to the valve device 58. The valve device 58 is connected to the upper inlet port 25 of the housing 12 via a back pressure introduction passage 68.

The valve device 58 may preferably be composed of a solenoid three-way valve. The valve device 58 is electrically connected to an electronic control unit 64, so as to be switched on and off in response to ON and OFF signals from the control unit 64. In particular, when the valve device 58 is switched off by the control unit 64, fluid communication between the control fuel introduction passage 66 and the back pressure introduction passage 68 can be broken or closed. At the same time, fluid communication between the back pressure introduction passage 68 and the valve exterior (interior of the fuel tank 52) can be established. Conversely, when the valve device 58 is switched on by the control unit 64, the fluid communication between the control fuel introduction passage 66 and the back pressure introduction passage 68 can be established. At the same time, the fluid communication between the back pressure introduction passage 68 and the valve exterior can be broken. As will be appreciated, when the fluid communication between the control fuel introduction passage 66 and the back pressure introduction passage 68 is established, the pressurized fuel in the control fuel introduction passage 66 is introduced into the back pressure chamber 34 as a control fuel or back pressure fuel. As a result, a pressure of the pressurized fuel in the control fuel introduction passage 66 (which pressure corresponds to the fuel pressure) can be applied to the back pressure chamber 34 as a control fuel pressure or back pressure BP (FIG. 4). Further, the pressurized fuel (the back pressure fuel) introduced into the back pressure chamber 34 via the control fuel introduction passage 66 and the back pressure introduction passage 68 may be referred to as "a back pressure fluid."

The electronic control unit 64 may essentially be composed of microcomputer-based devices. An input of the electronic control unit 64 may preferably be connected a detector that is capable of detecting whether an ignition switch (a start switch) of the engine is switched on. Conversely, an output of the electronic control unit 64 may preferably be connected the injectors (the fuel injection valves) of the engine. The control unit 64 is constructed to switch on and off the valve device 58 based on a condition of the engine. For example, the control unit 64 is constructed to switch on the valve device 58 for a predetermined period of time after the engine is started (i.e., after the ignition switch is switched on) and then to switch off the valve device 58. Further, the control unit 64 may preferably be referred to as "a control device."

Operation of the pressure control valve 10 will be described in detail.

As will be appreciated, the pressurized fuel is normally introduced into the pressure controlling chamber 32 via the pressurized fuel introduction passage 62. Therefore, the diaphragm 14 is normally (upwardly) applied with the fuel pressure. In this condition, when the pressurized fuel (the back pressure fuel) is introduced into the back pressure chamber 34, the control fuel pressure or back pressure BP can be applied to the back pressure chamber 34. Upon application of the back pressure BP, the plunger 18 can be applied with an enhanced downwardly biasing (pressing) force greater than a normal (initial) spring force of the valve spring 20 because the plunger 18 has the increased diameter. As a result, as shown in FIG. 2, the plunger 18 can be moved toward the lowermost position (the advanced position) while compressing the valve spring 20, so that the normal spring force of the valve spring 20 can be gradually increased or enhanced. As will be appreciated, in the lowermost position of the plunger 18, the retainer wall portion 18*a* of the plunger 18 contacts the lower stopper member 40.

When the plunger 18 is moved to the advanced position, the valve spring 20 is completely compressed so that a height (length) 20L of the valve spring 20 can be reduced or shortened (FIG. 2). As a result, the valve spring 20 may have an increased spring force which can be (downwardly) applied to the diaphragm 14 via the valve unit 16. Thus, the valve spring 20 may be set to a first or high set load (a high control load) that corresponds to the increased spring force. As a result, the pressure control valve 10 may be set to a first or high control pressure corresponding to the high set load of the valve spring 20.

In this condition, when the pressure of the pressurized fuel introduced into the pressure controlling chamber 32 is lower than the increased spring force of the valve spring 20, the diaphragm 14 may preferably be advanced (or deformed downwardly) by the spring force, so that the valve plate 16*d* of the valve unit 16 can contact the upper end of the vent port 29 as shown by broken lines in FIG. 2 (i.e., the valve unit 16 can be closed). As a result, the pressurized fuel in the pressure controlling chamber 32 may preferably be prevented from flowing out of the pressure controlling chamber 32 via the vent port 29, so that the pressure of the pressurized fuel in the pressure controlling chamber 32 can be effectively increased until the pressure becomes equal to the increased spring force of the valve spring 20. Conversely, when the pressure of the pressurized fuel introduced into the pressure controlling chamber 32 is higher than the increased spring force of the valve spring 20, the diaphragm 14 may preferably be retracted (or deformed upwardly) by the pressure of the pressurized fuel, so that the valve plate 16*d* of the valve unit 16 can be spaced away from the upper end of the vent port 29 as shown by solid lines in FIG. 2. As a result, a portion (an excess fluid) of the pressurized fuel in the pressure controlling chamber 32 may preferably flow out of the pressure controlling chamber 32 via the vent port 29 as a return fuel, so that the pressure of the pressurized fuel in the pressure controlling chamber 32 can be effectively decreased until the pressure becomes equal to the increased spring force of the valve spring 20. Further, when the pressure of the pressurized fuel in the pressure controlling chamber 32 is reduced to a pressure level lower than the increased spring force of the valve spring 20 as a result of flowing out of pressurized fuel, the diaphragm 14 may preferably be advanced again by the increased spring force, so that the valve unit 16 can be closed. Thus, the pressure of the pressurized fuel in the pressure controlling chamber 32 can be effectively controlled to the high control pressure.

Conversely, when the pressurized fuel (the back pressure fuel) is not introduced into the back pressure chamber 34 (i.e, when the back pressure BP is not applied to the back pressure chamber 34), the plunger 18 can be applied with a limited downwardly biasing force lower than the normal spring force of the valve spring 20. Therefore, as shown in FIG. 1, the plunger 18 can be moved to the uppermost position (the retracted position) by the normal spring force of the valve spring 20. As will be appreciated, in the uppermost position of the plunger 18, the retainer wall portion 18*a* of the plunger 18 contacts the upper stopper member 38.

When the plunger 18 is moved to the retracted position, the valve spring 20 is expanded such that the height (length) 20L of the valve spring 20 can be increased or lengthened (FIG. 1). As a result, the valve spring 20 may have a reduced spring force (the normal spring force) which can be (downwardly) applied to the diaphragm 14 via the valve unit 16. Thus, the valve spring 20 may be set to a second or low set load (a low control load) corresponding to the reduced spring force. As a result, the pressure control valve 10 may be set to a second or low control pressure (a steady control pressure) corresponding to the low set load of the valve spring 20.

In this condition, when the pressure of the pressurized fuel introduced into the pressure controlling chamber 32 is lower than the reduced spring force of the valve spring 20, the diaphragm 14 may preferably be advanced (or deformed downwardly) by the reduced spring force, so that the valve plate 16*d* of the valve unit 16 can contact the upper end of the vent port 29 as shown by broken lines in FIG. 1 (i.e., the valve unit 16 can be closed). As a result, the pressurized fuel in the pressure controlling chamber 32 may preferably be prevented from flowing out of the pressure controlling chamber 32 via the vent port 29, so that the pressure of the pressurized fuel in the pressure controlling chamber 32 can be effectively increased until the pressure becomes equal to the reduced spring force of the valve spring 20. Conversely, when the pressure of the pressurized fuel introduced into the pressure controlling chamber 32 is higher than the reduced spring force of the valve spring 20, the diaphragm 14 may preferably be retracted (or deformed upwardly) by the pressure of the pressurized fuel, so that the valve plate 16*d* of the valve unit 16 can be spaced away from the upper end of the vent port 29 as shown by solid lines in FIG. 1. As a result, a portion (an excess fluid) of the pressurized fuel in the pressure controlling chamber 32 may preferably flow out of the pressure controlling chamber 32 via the vent port 29 as a return fuel, so that the pressure of the pressurized fuel in the pressure controlling chamber 32 can be effectively decreased until the pressure becomes equal to the reduced spring force of the valve spring 20. Further, when the pressure of the pressurized fuel in the pressure controlling chamber 32 is reduced to a pressure level lower than the reduced spring force of the valve spring 20 as a result of flowing out of pressurized fuel, the diaphragm 14 may preferably be advanced again by the reduced spring force, so that the valve unit 16 can be closed. Thus, the pressure of the pressurized fuel in the pressure controlling chamber 32 can be effectively controlled to the low control pressure.

According to the pressure control valve 10, the plunger 18 can be moved to the retracted position (FIG. 1) or the advanced position (FIG. 2) depending upon whether the back pressure fuel is introduced into the back pressure chamber 34, so that the valve spring 20 can be set to two different set loads (i.e., the low set load and the high set load). As a result, the pressure control valve 10 can be reliably set to two different control pressures (i.e., the low control pressure and the high control pressure) that correspond to the high and low set loads of the valve spring 20.

In particular, when the back pressure fuel is introduced into the back pressure chamber 34, the plunger 18 can be moved to the advanced position (FIG. 2). The plunger 18 thus moved can be reliably maintained at the advanced position because the plunger 18 may preferably be applied with the enhanced downwardly biasing force. Therefore, the increased spring force of the valve spring 20 can be reliably maintained. As a result, the high set load of the valve spring 20 can be reliably maintained. Thus, the high control pressure of the pressure control valve 10 can be reliably maintained because such a high control pressure can be directly determined by the high set load (the increased spring force) of the valve spring 20.

Further, when the back pressure fuel is not introduced into the back pressure chamber 34, the plunger 18 can be moved to the retracted position (FIG. 1). The plunger 18 thus moved can be reliably maintained at the retracted position by the normal spring force of the valve spring 20. Thus, the low control pressure of the pressure control valve 10 can be reliably maintained because such a low control pressure can be directly determined by the low set load (the normal spring force) of the valve spring 20.

Therefore, even if the back pressure BP applied to the back pressure chamber 34 is changed or fluctuated, the high control pressure of the pressure control valve 10 cannot be changed or fluctuated. As a result, the pressure of the pressurized fuel in the pressure controlling chamber 32 can be effectively prevented from being changed or fluctuated in proportion to the change or fluctuation of the back pressure BP applied to the back pressure chamber 34. This means that the pressure of the pressurized fuel in the pressure controlling chamber 32 can be accurately controlled. For example, even if the back pressure BP applied to the back pressure chamber 34 is excessively increased, the pressure in the pressure controlling chamber 32 can be effectively prevented from excessively increasing beyond the high control pressure. Therefore, the pressure in the pressure controlling chamber 32 can be accurately controlled to the high control pressure. As a result, the fuel pressure can be accurately controlled. This may lead to an excellent controllability of the fuel pressure.

Next, operation of the fuel-feeding device 50 thus constructed will be described in detail.

When the engine is started (when the ignition switch is switched on), the valve device 58 is switched on or opened in response to the ON signal from the control unit 64, so that the control fuel introduction passage 66 communicates with the back pressure chamber 34 of the pressure control valve 10 via the back pressure introduction passage 68 (FIG. 4). As a result, the pressurized fuel (the back pressure fuel) in the control fuel introduction passage 66 can be introduced into the back pressure chamber 34, so that the back pressure BP can be applied to the back pressure chamber 34. Upon application of the back pressure BP, as best shown in FIG. 2, the plunger 18 can be moved to the lowermost position (the advanced position) while compressing the valve spring 20. As a result, as previously described, the pressure control valve 10 may preferably be set to the high control pressure. Further, as described above, the pressurized fuel in the fuel feeder passage 60 is normally introduced into the pressure controlling chamber 32 of the control valve 10 via the pressurized fuel introduction passage 62. Therefore, as described above, the pressure of the pressurized fuel introduced into the pressure controlling chamber 32 may preferably be controlled to the high control pressure. As a result, the fuel pressure (i.e., the pressure of the pressurized fuel fed to the engine pumped via the fuel feeder passage 60) may preferably be controlled to the high control pressure. Further, in this embodiment, the high control pressure may preferably correspond to about 600 kPa. As will be recognized, the control unit 64 may preferably be set to continuously transmit the ON signal for a predetermined period of time after the engine is started, so that the valve device 58 can be continued to be switched on for the predetermined period of time.

As will be recognized, when the fuel pressure is controlled to the high control pressure (e.g., about 600 kPa), the fuel can be atomized into fine particles by the injectors. This may lead to improved startability of the engine and reduced emission performance.

After an elapse of the predetermined period of time after the engine is started, the valve device 58 is switched off or closed in response to the OFF signal from the control unit 64, so as to stop the fluid communication between the control fuel introduction passage 66 and the back pressure introduction passage 68 and to establish the fluid communication between the back pressure introduction passage 68 and the valve exterior (FIG. 3). As a result, the pressurized fuel (the back pressure fuel) in the control fuel introduction passage 66 can be prevented from being introduced into the back pressure chamber 34, so that the back pressure BP can be released from the back pressure chamber 34. Upon release of the back pressure BP, as best shown in FIG. 1, the plunger 18 can be moved to the uppermost position (the retracted position). As a result, as previously described, the pressure control valve 10 may preferably be set to the low control pressure. Therefore, as described above, the pressure of the pressurized fuel introduced into the pressure controlling chamber 32 of the control valve 10 via the pressurized fuel introduction passage 62 may preferably be controlled to the low control pressure (the steady control pressure). As a result, the fuel pressure (i.e., the pressure of the pressurized fuel fed to the engine pumped via the fuel feeder passage 60) may preferably be controlled to the low control pressure. Further, in this embodiment, the low control pressure may preferably correspond to about 400 kPa.

Thus, according to the fuel-feeding device 50, even if the back pressure BP applied to the back pressure chamber 34 is changed or fluctuated, the fuel pressure (i.e., the pressure of the pressurized fuel fed to the engine pumped via the fuel feeder passage 60) can be effectively prevented from being changed or fluctuated in proportion to the change or fluctuation of the back pressure BP. For example, even if the back pressure BP applied to the back pressure chamber 34 is excessively increased, the fuel pressure can be reliably prevented from excessively increasing beyond the high control pressure. Therefore, the fuel pressure can be accurately controlled the high control pressure. This may lead to an excellent controllability of the fuel pressure.

Further, according to the fuel-feeding device 50, it is not necessary to additionally provide a relief valve in order to control or release a portion of the back pressure BP when the back pressure BP applied to the back pressure chamber 34 is excessively increased. As a result, the fuel-feeding device 50 does not produce pressure losses caused by the relief valve.

Further, according to the fuel-feeding device 50, when the pressure control valve 10 is set to the low control pressure, the control fuel introduction passage 66 may preferably be closed (i.e., the pressurized fuel introduction passage 62 may preferably be prevented from communicating with the valve exterior (the interior of the fuel tank 52). Therefore, the pressure controlled pressurized fuel can be effectively introduced into the engine without producing pressure losses.

Further, according to the fuel-feeding device 50, because the valve device 58 is composed of the solenoid three-way valve, the back pressure introduction passage 68 (the back pressure chamber 34) can be easily switched between a condition in which it communicates with the control fuel introduction passage 66 and a condition in which it communicates with the valve exterior (interior of the fuel tank 52).

Various changes and modifications may be made to the fuel-feeding device 50. For example, in the embodiments, although the control fuel introduction passage 66 is branched from the pressurized fuel introduction passage 62, the control fuel introduction passage 66 can be directly connected to the discharge port of the fuel pump 54 or an additional discharge port (not shown) that is juxtaposed to the discharge port. Also, the control fuel introduction passage 66 can be directly connected to a vapor jet or relief port (not shown) formed in the fuel pump 54 or an additional relief port (not shown) juxtaposed to the vapor jet port.

Further, in the embodiments, the control unit 64 is constructed to open and close the valve device 58. However, the control unit 64 can be constructed to suitably control a flow rate of the pressurized fuel passing through the valve device 58.

Second Embodiment

A second detailed representative embodiment will now described with reference to FIGS. 5 and 6.

Because the second embodiment relates to the first embodiment, only the constructions and elements that are different from the first embodiment will be explained in detail. Elements that are the same in the first and second embodiments will be identified by the same reference numerals and a detailed description of such elements may be omitted.

Figure 5:
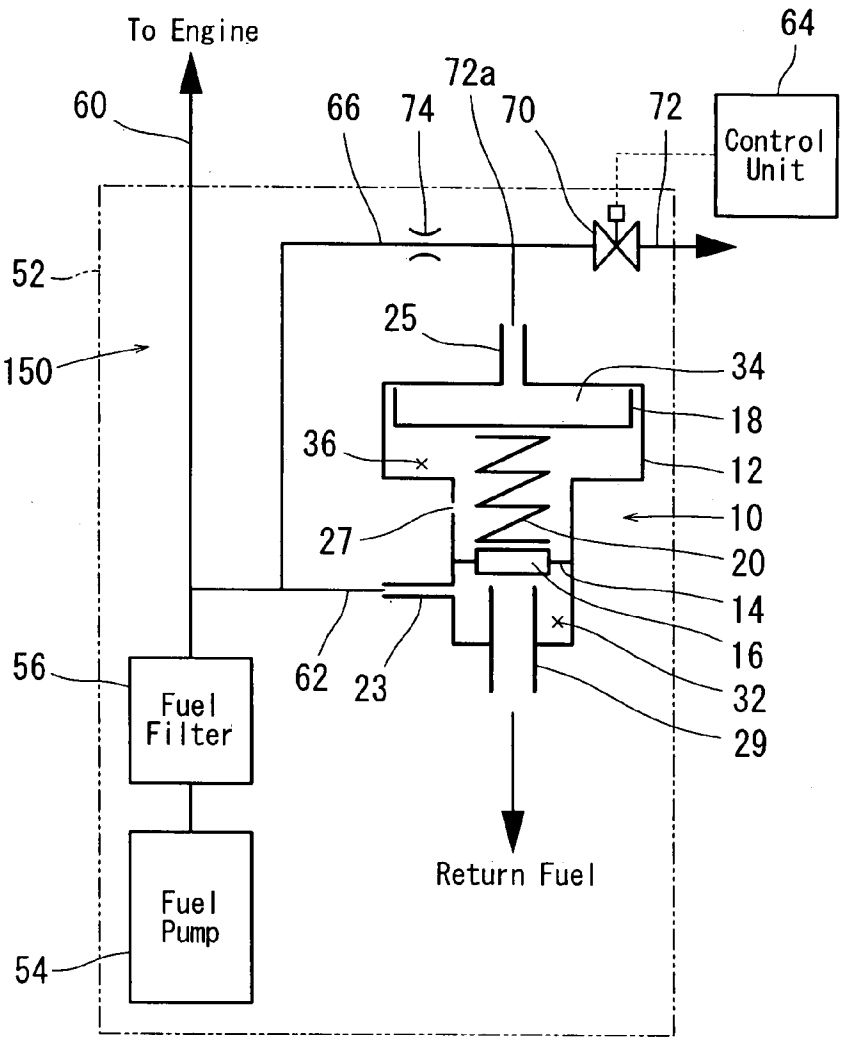
FIG. 5 is a schematic diagram of a fuel-feeding device according to a second embodiment of the present invention, in which a pressure control valve is controlled such that fuel can be fed to an engine at a low control pressure.
Figure 6:
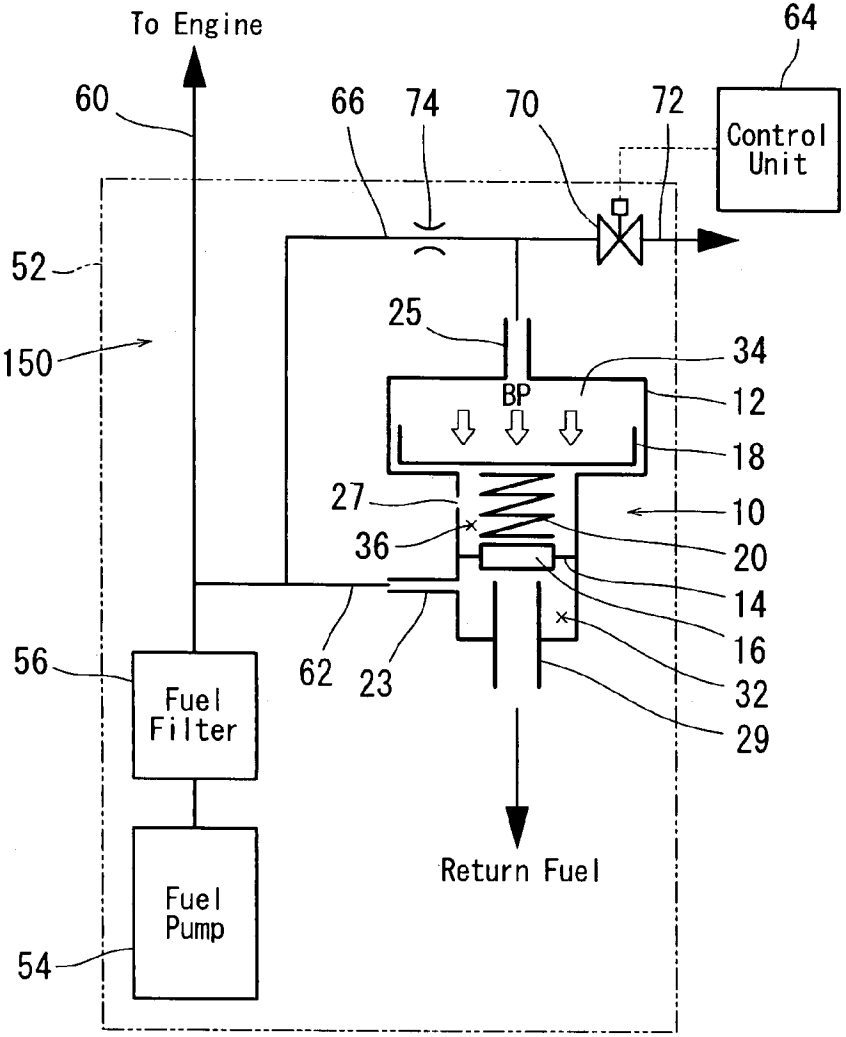
FIG. 6 is a schematic diagram of the fuel-feeding device, in which the pressure control valve is controlled such that the fuel can be fed to the engine at a high control pressure.

In a fuel-feeding device 150 of this embodiment, as shown in FIGS. 5 and 6, the valve device 58 in the first embodiment is replaced with a valve device 70 that is composed of a solenoid shutoff valve. Further, in this embodiment, the control fuel introduction passage 66 is directly connected to the upper inlet port 25 of the housing 12. Also, a relief passage 72 is branched from the control fuel introduction passage 66 so as to communicate with the valve exterior (interior of the fuel tank 52). As will be apparent, the relief passage 72 is branched from a branched portion 72*a* corresponding to the upper inlet port 25. The valve device 70 is disposed in the relief passage 72 and is electrically connected to the electronic control unit 64. Further, a squeezing portion 74 is formed in the control fuel introduction passage 66. The squeezing portion 74 may preferably be positioned upstream of the branched portion 72*a*. As will be appreciated, the squeezing portion 74 is arranged and constructed to restrict a flow rate of the pressurized fuel such that a desired amount of pressurized fuel can be introduced into the back pressure chamber 34.

Similar to the valve device 58, the valve device 70 is switched on and off in response to the ON and OFF signals from the control unit 64. When the valve device 70 is switched on, the relief passage 72 is closed so that the pressurized fuel (the back pressure fuel) in the control fuel introduction passage 66 can be introduced into the back pressure chamber 34. Therefore, the back pressure BP can be applied to the back pressure chamber 34 (FIG. 6). As a result, similar to the first embodiment, the pressure control valve 10 may preferably be set to the high control pressure. Conversely, when the valve device 70 is switched off, the relief passage 72 is opened to the valve exterior so that the pressurized fuel in the control fuel introduction passage 66 can substantially be prevented from being introduced into the back pressure chamber 34 (FIG. 5). As a result, the pressure control valve 10 may preferably be set to the low control pressure. Thus, when the valve device 70 is switched on and off, the back pressure BP applied to the back pressure chamber 34 can be controllably changed, so that the pressure control valve 10 can be set to the low control pressure and the high control pressure. Therefore, the pressure of the pressurized fuel in the pressure controlling chamber 32 can be controlled to the high and low control pressures. As a result, similar to the first embodiment, the fuel pressure (i.e., the pressure of the pressurized fuel fed to the engine pumped via the fuel feeder passage 60) can be controlled to the high and low control pressures.

Modified Form of First and Second Embodiments

The pressure control valve 10 (FIGS. 1 and 2) used in the fuel-feeding devices 50 and 150 according to the first and second embodiments of the present invention can be suitably modified. A modified form of the pressure control valve 10 will now described with reference to FIG. 7.

Because the modified form relates to the pressure control valve 10, only the constructions and elements that are different from the pressure control valve 10 will be explained in detail. Elements that are the same in the first and second embodiments will be identified by the same reference numerals and a detailed description of such elements may be omitted.

Figure 7:
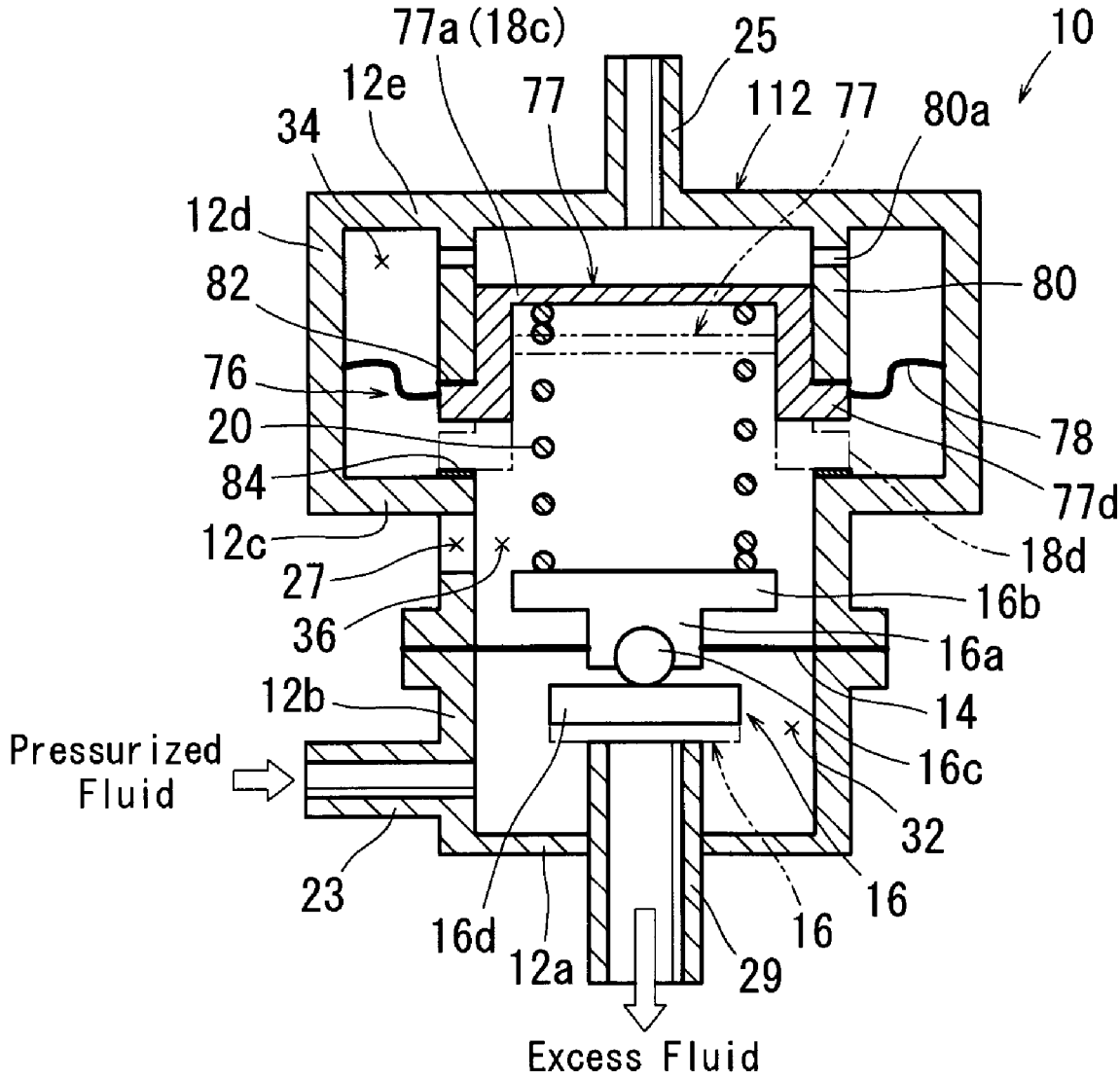
FIG. 7 is a view similar to FIG. 1, which illustrate a modified form of the pressure control valve used in the fuel-feeding devices according to the first and second embodiments of the present invention.
Figure 8:
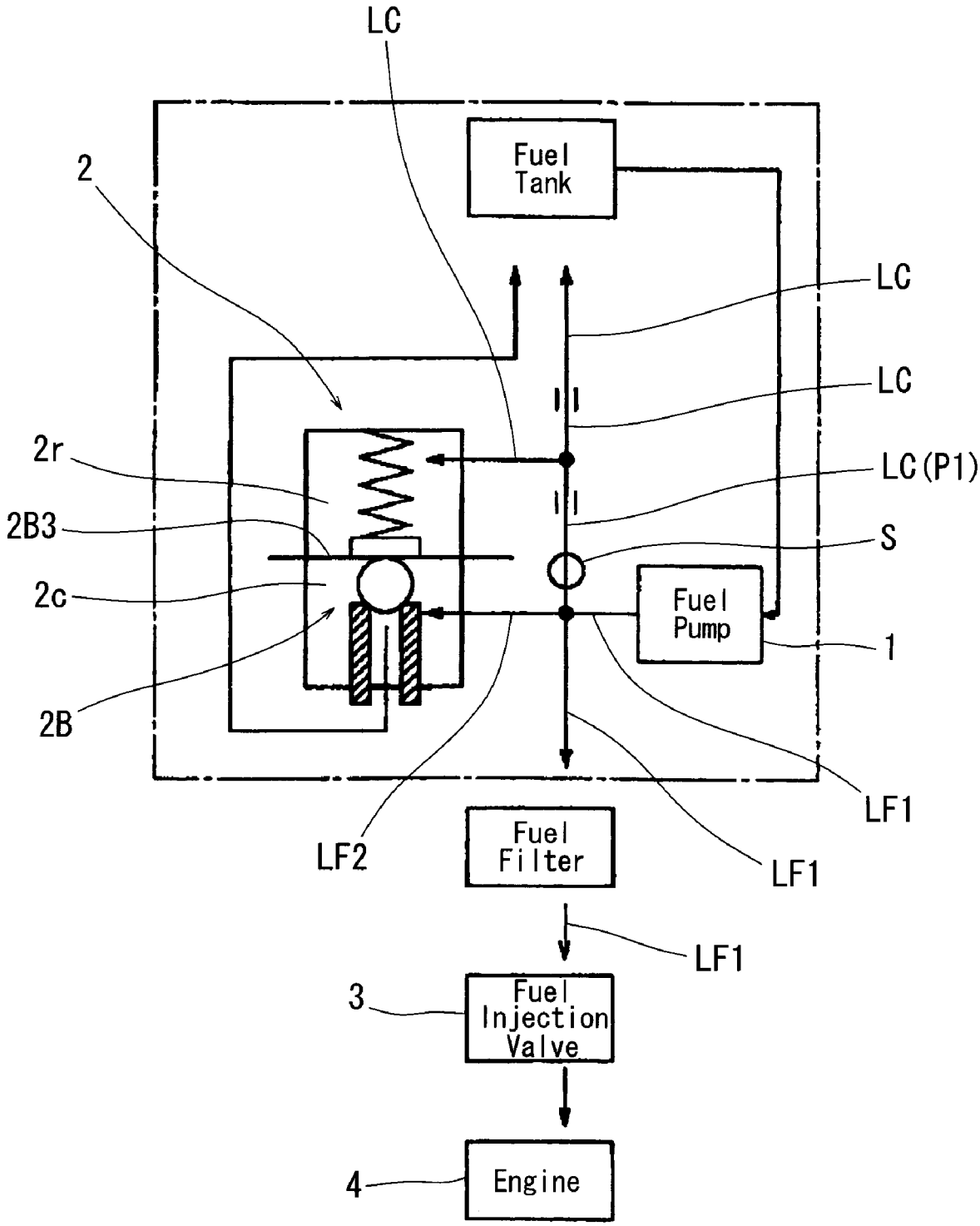
FIG. 8 PRIOR ART
FIG. 8 is a schematic diagram of a conventional fuel-feeding device having a pressure control valve.

As shown in FIG. 7, a modified pressure control valve 110 may preferably include a housing 112 and a plunger 76 (the second movable dividing wall) instead of the housing 12 and the plunger 18 of the pressure control valve 10. Unlike the housing 12, the housing 112 additionally includes a cylindrical guide wall portion 80 that is integrally formed in a lower (inner) surface of the upper wall portion 12*e*. The guide wall portion 80 extends downwardly toward an upper surface of the flanged portion 12*c*. The guide wall portion 80 may preferably be positioned concentrically with the upper side wall portion 12*d* and have substantially the same inner diameter as the lower side wall portion 12*b*. Further, the guide wall portion 80 may preferably have a length (height) substantially equal to half of the upper side wall portion 12*d* such that an annular opening can be formed between a lower end surface of the guide wall portion 80 and the upper surface of the flanged portion 12*c*.

Unlike the plunger 18, the plunger 76 may preferably be composed of a plunger body 77 and an annular diaphragm 78. The plunger body 77 may preferably be composed of a topped cylindrical main body 77*a* (which corresponds to the recessed portion 18*c*) and an annular flanged portion 77*b* that is transversely outwardly extended from a lower end portion of the main body 77*a*. The diaphragm 78 is positioned so as to encircle the flanged portion 77*b* and is hermetically connected thereto along an inner periphery thereof. The diaphragm 14 may preferably be formed from elastic materials such as rubber, so as to be elastically deformed or flexed vertically (in a thickness direction). The plunger 76 may preferably be vertically movably disposed in the upper side wall portion 12*d* of the housing 112. In particular, the main body 77*a* is closely received in the guide wall portion 80 while the flanged portion 77*b* is positioned in the annular opening formed between the lower end surface of the guide wall portion 80 and the upper surface of the flanged portion 12*c*. Further, an outer periphery of the diaphragm 78 is hermetically connected to a vertically central portion of the upper side wall portion 12*d* of the housing 112.

Further, a plurality of through holes 80*a* are formed in an upper end portion of the guide wall portion 80 so as to communicate between inside and outside of the guide wall portion 80. Thus, similar to the pressure control valve 10, the back pressure chamber 34 may preferably be defined in the housing 112 by the plunger 76 (i.e., the plunger body 77 and the diaphragm 78). As will be recognized, similar to the pressure control valve 10, the plunger 76 may preferably have an effective pressure receiving area greater than the diaphragm 14

In addition, in the pressure control valve 110, instead of the upper stopper member 38 of the pressure control valve 10, an annular plate-shaped upper stopper member 82 is attached to the lower end surface of the guide wall portion 80. Similarly, instead of the lower stopper member 40 of the pressure control valve 10, an annular plate-shaped lower stopper member 84 is attached to the upper surface of the flanged portion 12*c*. The lower stopper member 84 may preferably be positioned so as to be vertically aligned with the upper stopper member 82.

According to the pressure control valve 110, when the pressurized fuel (the back pressure fuel) is introduced into the back pressure chamber 34, the pressurized fuel can be applied to both of the plunger body 77 and the diaphragm 78, so that the plunger body 77 is pressed downwardly while the diaphragm 78 is deformed (pressed) downwardly. At this time, the plunger body 77 can be applied with an enhanced downwardly biasing force greater than the normal spring force of the valve spring 20 because the pressing force applied to the plunger body 77 can be increased due to the downward deformation of the diaphragm 78. As a result, the plunger body 77 can be moved toward a lowermost position (an advanced position) while compressing the valve spring 20. As will be appreciated, in the lowermost position of the plunger body 77, as shown by broken lines in FIG. 7, the flanged portion 77*b* of the plunger body 77 contacts the lower stopper member 84.

Conversely, when the pressurized fuel (the back pressure fuel) is not introduced into the back pressure chamber 34, the pressurized fuel cannot be applied to the plunger body 77 and the diaphragm 78, so that the plunger body 77 can be moved toward an uppermost position (an retracted position). As will be appreciated, in the uppermost position of the plunger body 77, as shown by solid lines in FIG. 7, the flanged portion 77*b* of the plunger body 77 contacts the upper stopper member 82.

According to the pressure control valve 110, similar to the pressure control valve 10, the plunger 76 (the plunger body 77) can be moved to the retracted position or the advanced position depending upon whether the back pressure fuel is introduced into the back pressure chamber 34. Therefore, the pressure control valve 110 can be set to two different control pressures (i.e., the low control pressure and the high control pressure). Thus, the pressure control valve 110 may have the substantially same function as the pressure control valve 10.

In addition, the plunger 76 of the pressure control valve 110 may have increased sealing performance. Therefore, the back pressure fuel can be effectively prevented from leaking from the back pressure chamber 34 toward the open chamber 36.

Naturally, various changes and modifications may be made to the embodiments. For example, in the embodiments, the pressure control valve 10 and 110 is used in the fuel-feeding devices 50 and 150 that are constructed to feed the fuel to the engine. However, the pressure control valve 10 and 110 can be used in any devices that are constructed to feed various fluids (liquids and gases).

Further, the valve spring 20 can be formed from a disk spring. Also, the valve spring 20 can be replaced with various elastic members such as a rubber member.

Further, the diaphragm 14 (the first movable dividing wall) can be replaced with a plunger that has the same construction as the plunger 18 and 76 the first movable dividing wall. Similarly, the plunger 18 and 76 (the second movable dividing wall) can be replaced with a diaphragm that has the same construction as the diaphragm 14.

Further, the upper stopper member 38 and/or the lower stopper member 40 can be attached to the plunger 18. Similarly, the upper stopper member 82 and/or the lower stopper member 84 can be attached to the plunger body 77 of the plunger 76. In addition, the upper stopper member 38 and 82 and/or the lower stopper member 40 and 84 can be integrally formed in the housing 12 and 112.

Representative examples of the present invention have been described in detail with reference to the attached drawings. This detailed description is merely intended to teach a person of skill in the art further details for practicing preferred aspects of the present invention and is not intended to limit the scope of the invention. Only the claims define the scope of the claimed invention. Therefore, combinations of features and steps disclosed in the foregoing detail description may not be necessary to practice the invention in the broadest sense, and are instead taught merely to particularly describe detailed representative examples of the invention. Moreover, the various features taught in this specification may be combined in ways that are not specifically enumerated in order to obtain additional useful embodiments of the present invention.

What is claimed is:

1. A fuel-feeding device, comprising:

a fuel pump capable of feeding fuel contained in a fuel tank to an engine;

a pressure control valve capable of controlling a pressure of pressurized fuel pumped from the fuel pump; and a valve device, wherein the pressure control valve comprises a housing having an inner cavity, a first movable dividing wall, a second movable dividing wall, a valve unit and a resilient member, wherein the first and second movable dividing walls divide the housing cavity to a pressure controlling chamber having a pressurized fuel inlet port through which the pressurized fuel is introduced into the pressure controlling chamber and an excess fuel relief port through which a portion of the pressurized fuel in the pressure controlling chamber flows out, a back pressure chamber having a back pressure fuel inlet port through which the pressurized fuel is introduced into the back pressure chamber as a back pressure fuel, and an open chamber positioned between the pressure controlling chamber and the back pressure chamber and communicating with exterior of the housing, wherein the valve unit is attached to the first movable dividing wall and capable of closing and opening the excess fuel relief port, wherein the resilient member is disposed between the first and second movable dividing walls so as to normally biasing the valve unit in a valve closing direction, wherein the second movable dividing walls is arranged and constructed to move to a retracted position or an advanced position depending upon whether the back pressure fuel is introduced into the back pressure chamber, thereby setting the resilient member to two different set loads, and wherein the valve device is arranged and constructed to controllably introduce the back pressure fuel into the back pressure chamber.

2. The fuel-feeding device as defined in claim 1, wherein the pressure control valve further comprises a first stopper device and a second stopper device that are respectively arranged and constructed to stop the second movable dividing wall at the retracted position and the advanced position.

3. The fuel-feeding device as defined in claim 1, wherein the second movable dividing wall has an effective pressure receiving area greater than the first movable dividing wall.

4. A pressure control valve capable of controlling a pressure of pressurized fluid, comprising:

a housing having an inner cavity;

a first movable dividing wall;

a second movable dividing wall;

a valve unit; and a resilient member, wherein the first and second movable dividing walls divide the housing cavity to a pressure controlling chamber having a pressurized fluid inlet port through which the pressurized fluid is introduced into the pressure controlling chamber and an excess fluid relief port through which a portion of the pressurized fluid in the pressure controlling chamber flows out, a back pressure chamber having a back pressure fluid inlet port through which the pressurized fluid is introduced into the back pressure chamber as a back pressure fluid, and an open chamber positioned between the pressure controlling chamber and the back pressure chamber and communicating with exterior of the housing, wherein the valve unit is attached to the first movable dividing wall and capable of closing and opening the excess fuel relief port, wherein the resilient member is disposed between the first and second movable dividing walls so as to normally biasing the valve unit in a valve closing direction, and wherein the second movable dividing walls is arranged and constructed to move to a retracted position or an advanced position depending upon whether the back pressure fluid is introduced into the back pressure chamber, thereby setting the resilient member to two different set loads.

5. The pressure control valve as defined in claim 4 further comprising a first stopper device and a second stopper device that are respectively arranged and constructed to stop the second movable dividing wall at the retracted position and the advanced position.

6. The pressure control valve as defined in claim 4, wherein the second movable dividing wall has an effective pressure receiving area greater than the first movable dividing wall.

* * * * *